United States Patent [19]

Garrett

[11] Patent Number: 4,774,726

[45] Date of Patent: Oct. 4, 1988

[54] ADJUSTABLE DRESS

[76] Inventor: Lynn S. Garrett, 125 Williamsburg Pl., Franklin, Tenn. 37064

[21] Appl. No.: 102,634

[22] Filed: Sep. 30, 1987

[51] Int. Cl.[4] ..... A41D 1/22

[52] U.S. Cl. ..... 2/105; 2/76; 2/106; 2/221

[58] Field of Search ..... 2/105, 106, 115, 74, 2/76, 235, 236, 237, 219, 220, 221

[56] References Cited

U.S. PATENT DOCUMENTS

| | | | |
|---|---|---|---|
| 2,259,236 | 10/1941 | Wellins et al. | 2/76 |
| 2,299,996 | 10/1942 | Kremer | 2/105 X |
| 2,418,582 | 4/1947 | Craig | 2/76 |
| 2,431,466 | 11/1947 | Craig | 2/76 |
| 3,013,277 | 12/1961 | Satin | 2/76 X |
| 4,377,007 | 3/1983 | Sudjian | 2/105 |

*Primary Examiner*—Louis K. Rimrodt
*Assistant Examiner*—Judith L. Olds
*Attorney, Agent, or Firm*—Steele, Gould & Fried

[57] ABSTRACT

An adjustable dress is disclosed which includes an adjustable crinoline or slip, an adjustable overskirt and an adjustable blouse. The slip is upwardly formed with a plurality of vertically spaced casings and is provided with a drawstring which is insertable into a casing to thereby provide the desired vertical dress length adjustment. The slip terminates downwardly in a fabric ruffle to form the finished bottom of the dress. An overskirt overfits the slip and is provided with a waist construction that is widely adjustable to fit substantially all sizes. The length of the overskirt is less than the length of the slip to thereby assure that the ruffle will bottomly extend below the overskirt. An adjustable blouse is fabricated of the same fabric as the slip ruffle and the overskirt and includes suitable drawstrings about the blouse top and sleeves to comfortably fit the shoulders, neckline and back of the wearer. The blouse sides are equipped with the left and right pluralities of vertically spaced elastic strips to automatically conform the bodice of the blouse to the size of the wearer.

18 Claims, 4 Drawing Sheets

ADJUSTABLE DRESS

BACKGROUND OF THE INVENTION

1. Field of the Invention

The present invention relates generally to the field of garment design and fabrication, and more particularly is directed to an adjustable dress construction wherein a single garment can be easily adjusted to comfortably fit substantially all wearers regardless of their particular sizes, shapes or weights.

2. Discussion of the Prior Art

Adjustable type garments have long been known and used in this country to permit a single article to be readily adjusted in size to thereby accommodate the varying dimensions of different wearers or perhaps to accommodate size changes in a single user. Maternity clothing with adjustable waist construction is characteristic of this latter type of garment. Wellins, et al, U.S. Pat. No. 2,259,236 shows a garment in the nature of a maternity shirt or dress which is adjustable to accommodate varying sizes of the waist of the wearer.

In U.S. Pat. No. 898,511, Scheider discloses a shirt construction having means for gathering the skirt at the back for changing the size of the waist so that the skirt may be fitted to different figures. Terrell, U.S. Pat. No. 2,394,019 discloses a draw string means in the form of a gathered waist belt so that the waist size can be readily altered to suit the desires of the wearer in a manner whereby the waist part of the garment will at all times retain a pleasing appearance.

Another type of adjustable skirt is disclosed in Stillson U.S. Pat. No. 723,063 wherein tapes are employed on either side of the placket opening to permit adjustment to fit any size or shape of waist or hips. After adjustment, the tapes are tied to maintain the adjustment irrespective of the nature or use of the placket fastening devices.

In U.S. Pat. No. 2,418,582 Stumpf teaches a simple garment in which fit is gained through the use of a plurality of drawstrings which are located to shape the garment at the points required. Friedman, U.S. Pat. No. 2,327,881 shows the use of a two piece waistline belt which is adapted to be used in conjunction with a uniform having a bodice portion and a skirt portion in manner to cause the skirt portion to drape in an outwardly flared formation. Pedlar, U.S. Pat. No. 2,109,867 relates to a combination garment comprising a blouse and a petticoat wherein the upper edge of the petticoat is attached to the lower edge of the blouse by employing a slide fastener.

Jeansan, U.S. Pat. No. 800,447 relates to a lady's undergarment wherein two skirt members are provided to take the place of a usual petticoat and are adapted to be removably secured about the lower ends of the legs of cooperating drawers. In U.S. Pat. No. 4,377,007, Sudjian discloses a convertible length garment having an overdress and a complimental underdress which is adapted to be worn beneath the overdress.

SUMMARY OF THE INVENTION

The present invention relates generally to the apparel field in the design and fabrication of dresses, and more particularly, relates to an adjustable dress design including an adjustable blouse, an adjustable overskirt and an adjustable slip.

The adjustable dress according to the present invention is fabricated in three discrete, separately adjustable pieces, namely, a slip or crinoline, a blouse and an overskirt. The slip comprises an upper section of relatively stiff nylon fabric which serves as a crinoline to make the dress bouffant and a large ruffle which is bottomly secured to the bottom edge of the nylon fabric. Preferably, the ruffle is fabricated of the same fabric as the blouse and the overskirt whereby the ruffle can conveniently form the bottom edge of the finished dress when the parts are assembled and worn. The top portion of the slip is designed with a plurality of vertically spaced casings, preferably twelve in number to permit a wide range of slip length adjustment to readily adjust the length of the dress to conform to the height of the wearer. A separate drawstring is provided for insertion into a chosen casing to thereby easily provide the desired length adjustment.

The blouse is fabricated of the same material as the ruffle of the slip and is designed to be large enough to provide at least a four size adjustment through the bust and waist sections of the garment. Lightweight elastic strips are horizontally sewn at each side seam in vertically spaced two inch increments from under the sleeve to the waist. The elastic strips thereby permit blouse bodice adjustment through four inches or four sizes to fit the figure of the wearer through a considerable size range. The sleeves of the blouse are full and terminate downwardly with elastic in casings around the arm for snug fit against the arms. The tops of the sleeves are designed to form the shoulders of the blouse and opposed casings are provided under poufs on the shoulder. Elastic strips are arranged within the casings with pulls or strings of the dress fabric endwardly attached to the elastic strips. Another dress fabric string is sewed into the back bodice-sleeve seam at the top of the blouse. In use, the string attached to the elastic is pulled to make the top of the sleeve fit comfortably over the wearer's shoulders and to adjust the dress neckline to the desired height.

The overskirt portion of the adjustable dress completes the ensemble and is provided with a fixed waistband in the front. The ends of the front waistband are elongated and extend to the back as adjustable belts. One of the belt ends is provided with a spaced series of pairs of thread loops and the other belt end is conventionally equipped with suitable metal hooks which correspond with and are engageable with a pair of thread loops for waist size adjustment purposes. The overskirt is formed with a center back seam which terminates upwardly in an open placket without a zipper. The top of the skirt is formed into a wide casing and a strip of heavy elastic, preferably one inch width, is inserted through the casing. The elastic strip is permanently secured at the center back and extends through buttonhole type openings at the side seams for temporary securing within the skirt. The elastic strip can then be expanded for very large figure or can be taken in to fit a smaller frame. The pulling of the elastic strips to fit the figure will provide the garment with the appearance of gathers in the skirt back. A skirt hook and loop can conventionally be attached at the center back at the top of the placket for placket closure purposes. The two belts can then be hooked tightly together over the elastic gathers of the skirt back to thereby complete the total ensemble. If desired, the bottom of the skirt can be drawn up at the vertical seams to thereby give a shirred effect to the appearance of the overskirt.

It is therefore an object of the present invention to provide an improved adjustable dress of the type set forth.

It is another object of the present invention to provide a novel adjustable dress comprising an adjustable slip, an adjustable blouse and an adjustable overskirt.

It is another object of the present invention to provide a novel adjustable dress comprising a blouse portion, a slip portion and an overskirt portion, which portions are individually adjustable whereby a single garment can be made universally adjustable to fit an extremely wide range of sizes in a minimum period of time.

It is another object of this invention to provide a novel adjustable dress comprising a slip portion having waist and length adjustment means and an overskirt provided with convenient waist adjustment means.

It is another object of the present invention to provide a novel dress construction that is simple in design, widely adjustable in construction and trouble-free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
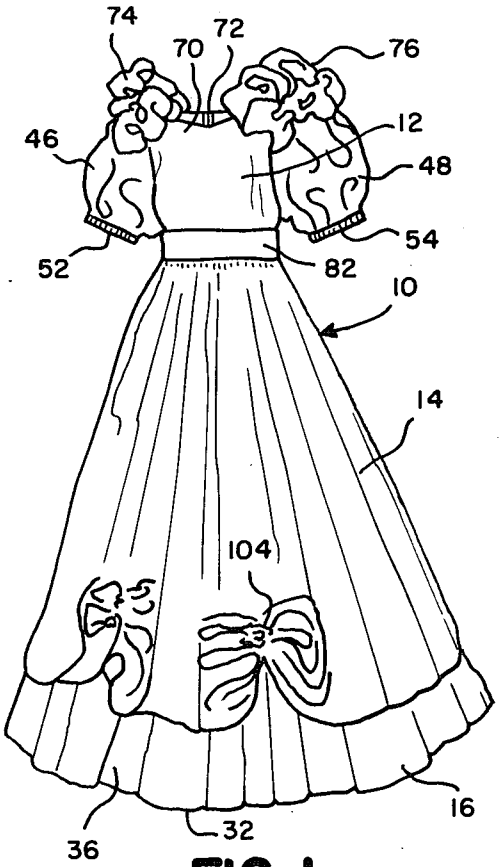
FIG. 1 is a front perspective view of the adjustable dress of the present invention.

Although specific terms are used in the following description for the sake of clarity, these terms are intended to refer only to the particular structure of the invention selected for illustration in the drawings, and are not intended to define or limit the scope of the invention.

Figure 2:
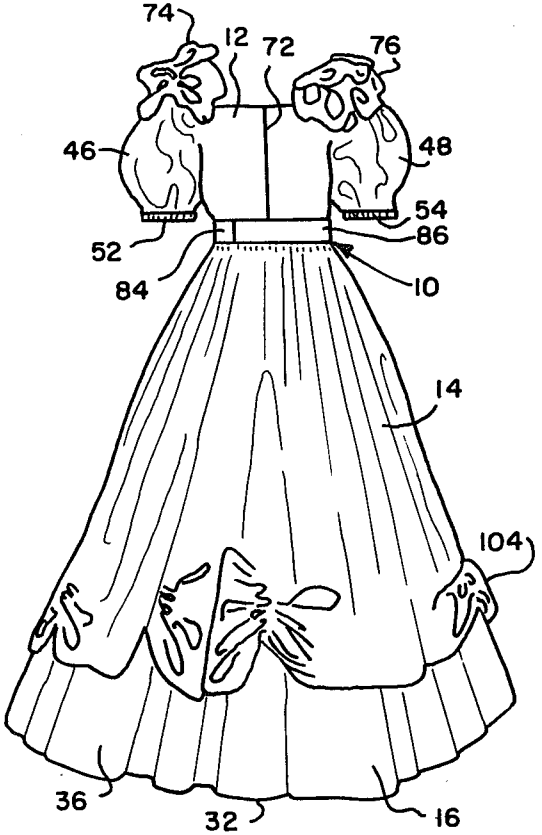
FIG. 2 is a rear perspective view of the adjustable dress.

Referring now to the drawings, there is shown in FIGS. 1 and 2 an adjustable dress 10 which is constructed in accordance with the present invention to readily and easily fit wearers of widely differing sizes and shapes. The adjustable dress 10 comprises generally an adjustable blouse 12, an adjustable slip or crinoline 16 and an adjustable overskirt 14.

Figure 6:
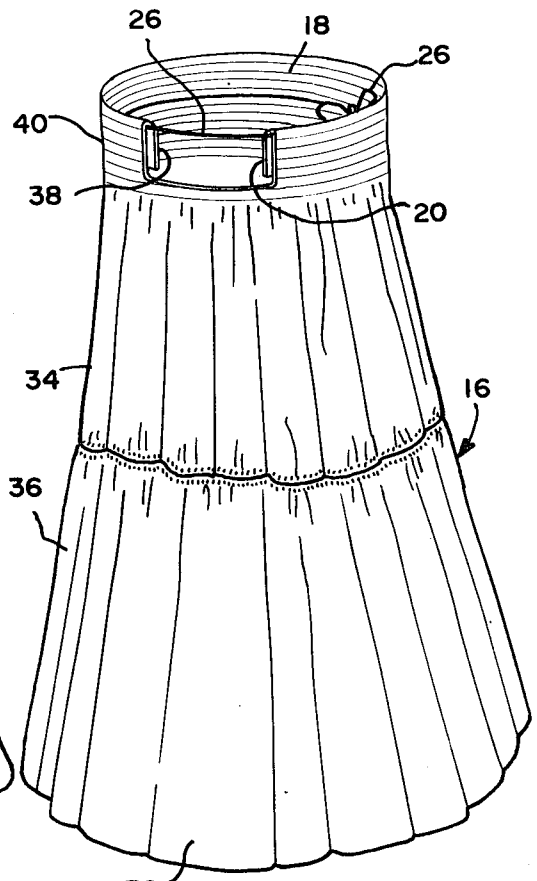
FIG. 6 is an enlarged perspective view of the slip when in use, with portions broken away to expose interior construction details.
Figure 5:
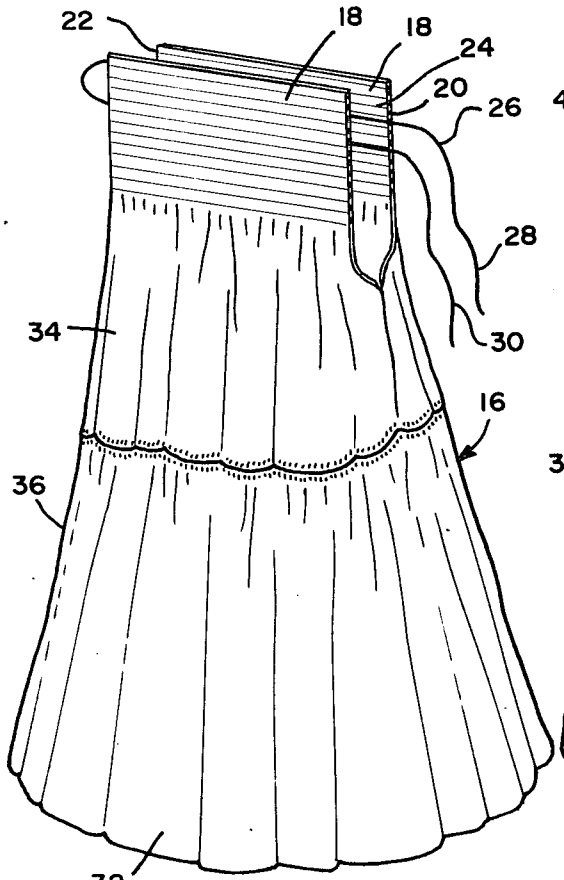
FIG. 5 is an enlarged perspective view of the slip.
Figure 4:
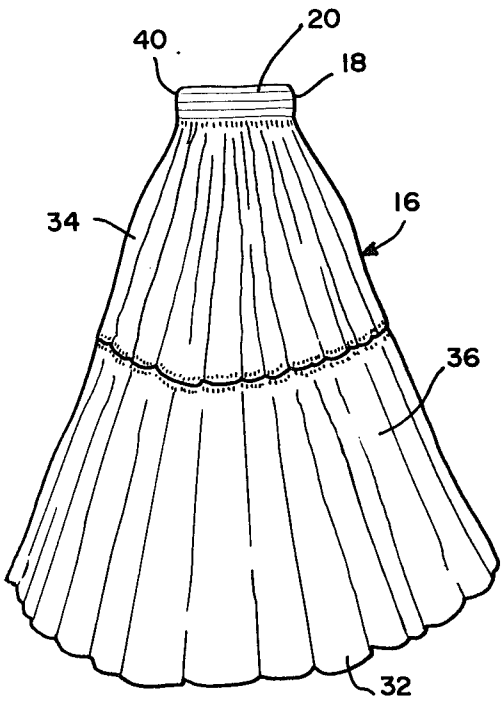
FIG. 4 is a perspective view of the slip.

As best seen in FIGS. 4, 5 and 6, the slip 16 is particularly designed to facilitate easy length adjustment. An upper, generally tubular, adjustment section 18 is fabricated of a soft, stretchy fabric and is sewn or otherwise treated to provide a plurality of similar casings 20 arranged in vertically spaced rows. A plurality of twelve such casings has proved satisfactory for the length adjustment purposes, but more or fewer casings could be employed and still fall within the meaning and scope of this invention. A drawstring 26 is provided through one of the casings 20 at the level desired to obtain the proper slip length, depending upon the height of the wearer and the desired elevation of the slip bottom edge 32 above the supporting surface (not shown).

The slip comprises a body portion 34 of relatively stiff nylon or other suitable fabric which serves as a crinoline to make the dress bouffant. The body portion 34 terminates upwardly in the relatively soft adjustment section 18 and downwardly in a large ruffle 36. Preferably, the ruffle 36 is made of the same fabric as the blouse 12 and the overskirt 14 whereby the dress will appear as a unitary garment when completely adjusted and assembled. For ease in adjustment, the slip adjustment section 18 is formed with a placket 22, 24 at each side. For a very large person, the plackets 22, 24 can be expanded evenly and can then be secured in their adjusted positions by tying the ends 28 and 30 of the drawstring 26. For a small person, the drawstring 26 draws the soft material of the adjustment section 18 in soft gathers which can be distributed equally about the waist of the wearer (not shown). After tying, the drawstring ends 28, 30 of the drawstring 26 and any extra casings that may be positioned above the drawstring can then be inwardly folded and tucked inside the slip 16 about the waist 40 thereof. See FIGS. 4 and 6.

Figure 7:
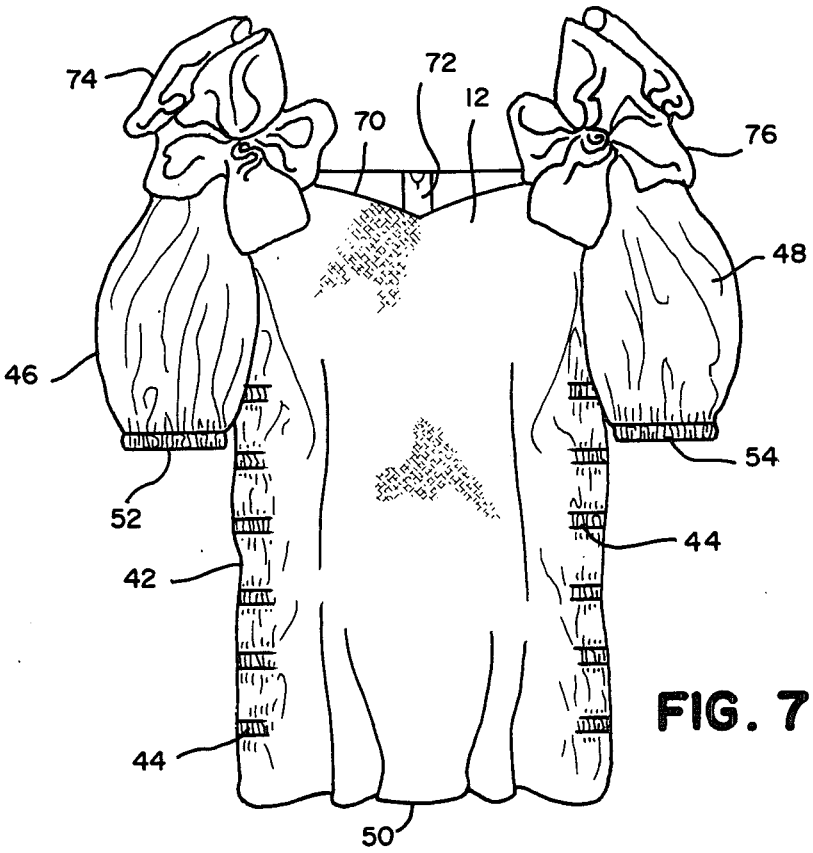
FIG. 7 is a front elevation view of the blouse.
Figure 8:
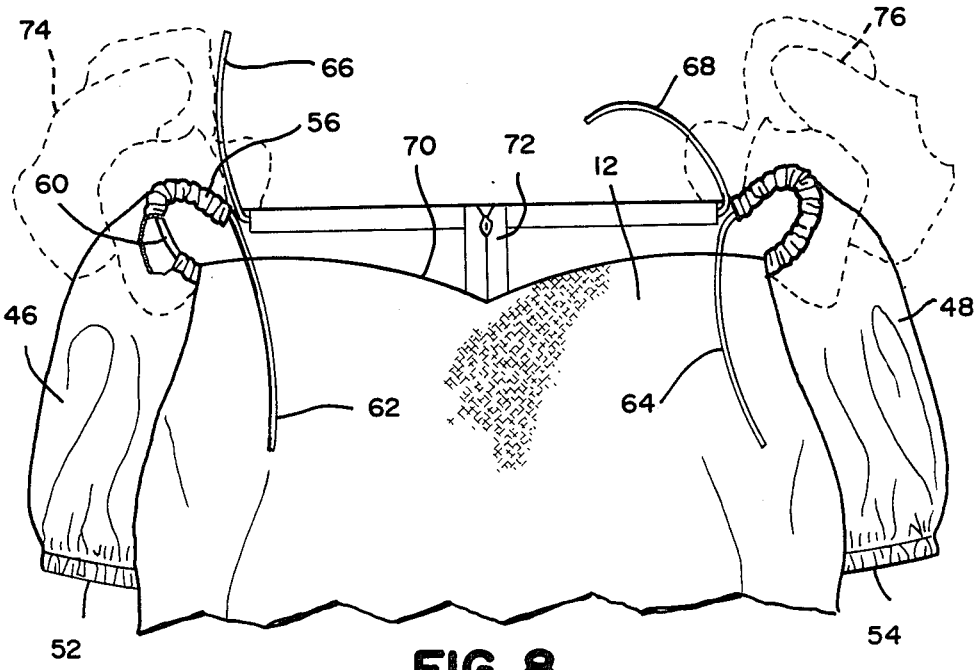
FIG. 8 is an enlarged, partial, front elevational view of the blouse with the poufs shown in phantom lines to more clearly show interior construction features.

Turning now to FIGS. 7 and 8, the adjustable blouse 12 comprises an adjustable bodice 42 which is designed to be cut four inches larger than the desired size. A plurality of lightweight elastic strips 44 are interiorly inserted horizontally along each side seam from under each sleeve 46, 48 to the blouse bottom or waist 50. When the blouse 12 is worn, the bodice portion 42 then expands or contracts the shirred elastic strips 44 to properly fit the figure of the wearer. In this manner a full four size, that is, four inch bodice adjustment can be provided to make the blouse 12 substantially universally adjustable without requiring major alternatives. As shown, the sleeves 46, 48 are fully formed and may be provided with elastic in casings 52, 54 to make the sleeves fit snugly about the arm (not shown) of the wearer. The elastic readily provides the required size adjustment to accommodate the arm peripheral dimensions of wearers of differing sizes.

Referring now to FIG. 8, it will be observed that the tops of the sleeves 46, 48 form the shoulders of the blouse 12. Casings 56, 58 are provided at the tops of the sleeves 46,48 and lengths of elastic 60 are secured within the casings. Strings 62, 64 made of the same fabric as the exterior portions of the dress are attached to the ends of the elastic strips 60. Additional strings 66, 68 formed of the dress fabric are sewn into the back bodice-sleeve seam at the top of the blouse for adjustment purposes. In use, the strings 62, 64 which are attached to the elastic strips 60 can be pulled as necessary to make the top of the sleeve fit comfortably over the shoulders of the wearer and to adjust the dress neckline 70 to the correct height. After the respective fabric strings 62, 66 and 64, 68 are adjusted to the satisfaction of the wearer, they can be tied, made into bows and then tucked inside the bodice. A back zipper 72 is provided and poufs 74, 76 which are preferably fabricated of the same fabric as the dress itself, can be conventionally attached.

Figure 9:
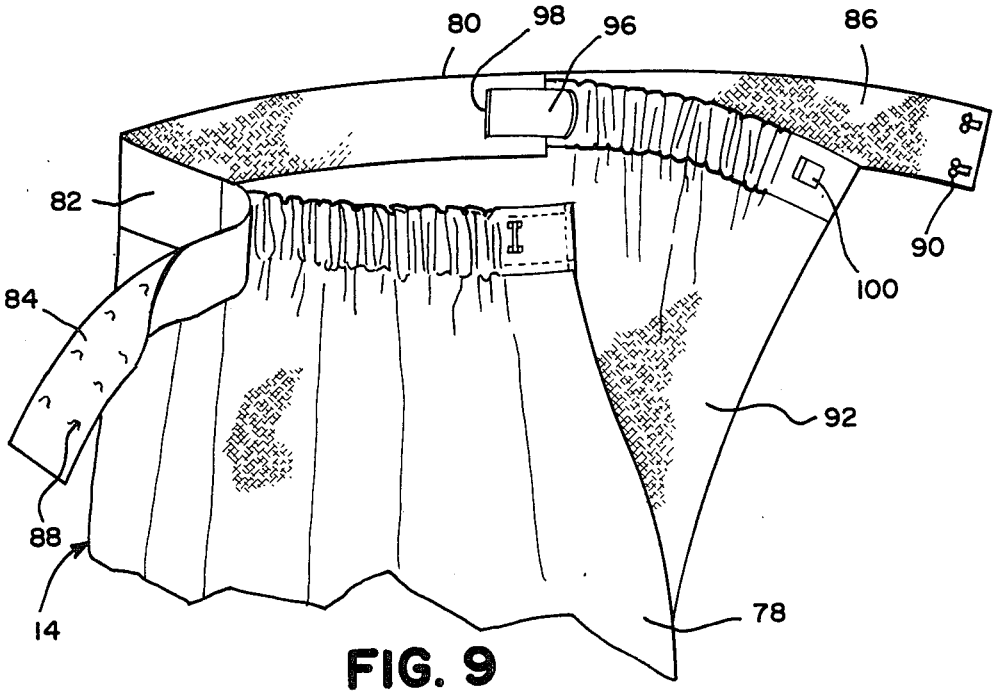
FIG. 9 is an enlarged, partial, perspective view of the upper portion of the overskirt prior to use.
Figure 10:
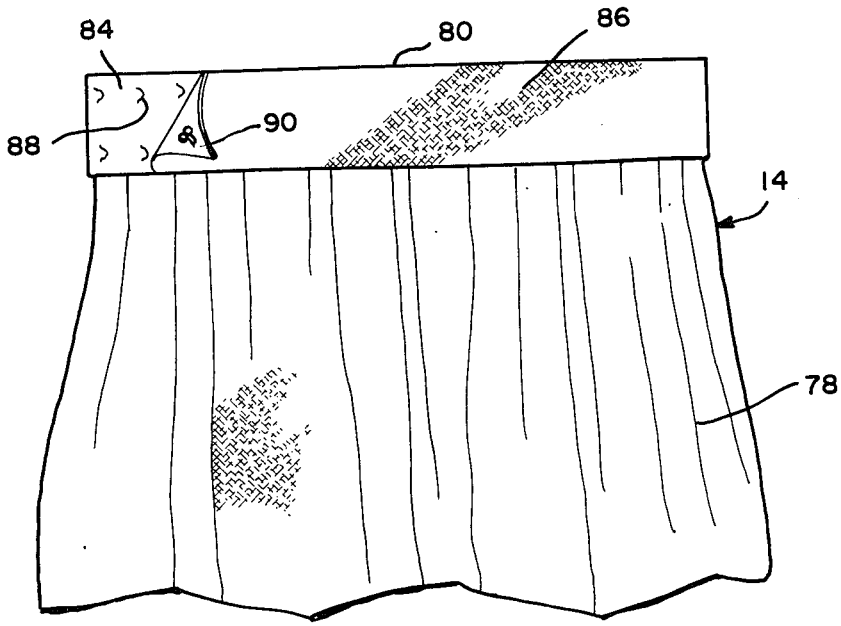
FIG. 10 is an enlarged, partial, perspective view of the upper portion of the overskirt with the placket closed and with the belt substantially closed.

As best seen in FIGS. 9 and 10, an overskirt 14 is fabricated of the same material as the other exterior portions which comprise the adjustable dress 10. Fabric panels 78 which may include a plurality of gores which are softly gathered in known manner are provided and terminate upwardly in an upper edge 80. A fixed front waistband 82 is sewed to the three gores comprising the front of the overskirt 14 and left and right belts 84, 86 integrally extend rearwardly from the waistband 82. As shown, the left belt 84 is provided with fasteners which may be a plurality of spaced rows of thread loops 88, which rows are preferably spaced at one inch intervals. The right belt 86 is endwardly provided with cooperating fasteners, such as conventional hooks 90 which are spaced apart to correspond to the spacing between the loops 88 which comprise each row.

The skirt back may be fabricated with four gores in known manner and a rear placket 92 extends from the upper edge 80 down the center back seam for approximately twelve inches. It is noteworthy that the placket 92 is open and is not closed by a zipper. The top of the skirt is sewn or otherwise treated to provide a wide casing 94 within which heavy elastic strips 96, which may be one inch wide elastic, are inserted. The elastic strips 96 are permanently secured at one end at the center back of the overskirt adjacent to the placket 92. The other ends of the elastic strips 96 extend through a buttonhole type opening 98 which is provided through the casing 94 at the side seams and are temporarily secured inside of the waistband. The elastic strips 96 can then be readily expanded for a full figure or taken in for a smaller frame. By pulling the elastic strips 96 to fit the figure, the material forming the casing 94 will be pulled together to give the appearance of gathers in the skirt back. As shown in FIG. 9 a conventional skirt hook is attached at the center back at one side of the placket 92 to cooperatively engage the skirt eye 102 which is affixed to the center back at the opposite side of the placket 92.

Figure 3:
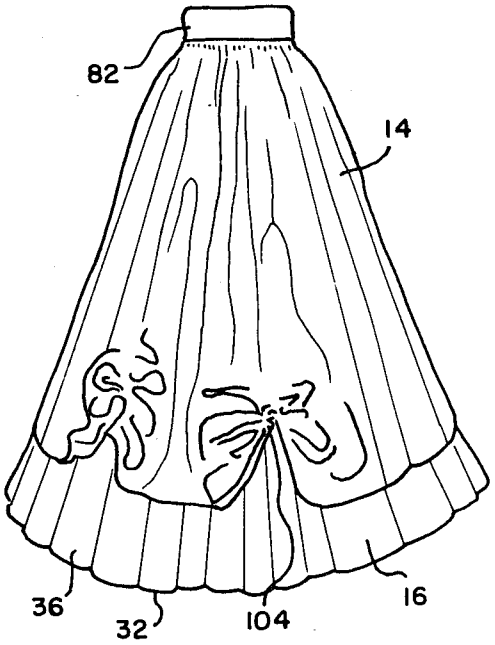
FIG. 3 is a perspective view of the overskirt and slip in use with the blouse removed.

As illustrated in FIGS. 1, 2, and 3, the bottom of the overskirt 14 may be drawn up in gathers 104 at each of the seams excluding the center back seam to provide a shirred effect to the overskirt. In use, the slip or crinoline 16 can first be fitted by inserting the drawstring 26 into the correct vertically adjusted casing 20 and then tying the drawstring. The end of the drawstring 26 and the folded portion of the adjustment section 18 comprising the extra casings 38 can then be worn and properly adjusted by closing the zipper 72 and tying the respective fabric strings 62, 66 and 64, 68 to properly fit the sleeves and neckline to the figure of the wearer. The spaced elastic strips 44 will be self adjusting. The overskirt 14 can then be worn over the slip 16 by adjusting the elastic strips 96 for comfort, securing the hook and eye 100, 102 and by attaching the hooks 90 and loops 88 of the belts 84, 86. As shown, when properly adjusted, the ruffle 36 of the slip 16 extends below the bottom edge of the overskirt 14 and thus provides the adjustable, finished bottom edge 32 for the adjustable dress 10.

Although the present invention has been described with reference to the particular embodiments herein set forth, it is understood that the present disclosure has been made only by way of example and that numerous changes in the details of the construction may be resorted to without departing from the spirit and scope of the invention. Thus, the scope of the invention should not be limited by the foregoing specification, but rather, only by the scope of the claims appended hereto.

What is claimed is:

1. An adjustable dress that is adaptable for use with wearers of various sizes and shapes comprising a slip, the slip comprising a body portion of relatively stiff fabric, the body portion terminating upwardly in an adjustment section and downwardly in a ruffle, the adjustment section being formed with a plurality of vertically spaced casings, the casings terminating endwardly in left and right plackets;

a draw string insertable into any one of the said slip casings, the draw string having ends exposed at one of the said plackets to permit the slip to be secured to the wearer by tying the said ends;

an overskirt overfitting the slip, the overskirt being of a length that is less than the length of the slip, the overskirt comprising a plurality of interconnected skirt gores, the skirt gores defining a skirt front and a skirt rear and having upper portions, the overskirt terminating upwardly in a generally circular upper edge, the upper portions of two adjacent gores not being sewn at the said upper edge and for a length extending downwardly therefrom, the said unsewn upper portion lengths defining an open placket therebetween, the gores terminating downwardly above the bottom of the said ruffle, the overskirt comprising a waistband secured to the tops of some but not all of the gores, the waistband terminating outwardly of the gores in left and right belts; and a blouse upwardly extending from the upper edge of the overskirt, the blouse comprising a bodice and means to adjust the size of the bodice, the bodice terminating upwardly in a front neckline and a rear top, and a fabric string secured to the rear top for blouse adjustment purposes;

whereby an adjustable dress construction can be provided to permit individual size adjustment of the slip, the overskirt and the blouse to suit the size and style considerations of the individual wearer.

2. The adjustable dress of claim 1 wherein the fabric of the ruffle and the fabric of the overskirt are the same.

3. The adjustable dress of claim 1 wherein the fabrics comprising the ruffle, the overskirt and the blouse are the same.

4. The adjustable dress of claim 1 wherein the adjustment section of the slip is fabricated of material different from the material of the body portion, the adjustment section comprising soft, stretchy fabric.

5. The adjustable dress of claim 1 wherein the means to adjust the bodice comprises a plurality of vertically spaced elastic strips.

6. The adjustable dress of claim 1 wherein the blouse comprises a left side and a right side and wherein a plurality of vertically spaced elastic strips is secured to the bodice at the left side and a similar plurality of vertically spaced elastic strips is secured to the bodice at the right side.

7. The adjustable dress of claim 1 wherein the left and right belts of the overskirt secure together over the placket and close the placket.

8. The adjustable dress of claim 7 wherein one belt comprises a plurality of spaced loops and the other belt comprises a hook, the hook being adapted to engage any one loop to secure the left and right belts together.

9. The adjustable dress of claim 1 wherein the blouse comprises left and right sleeves secured to the bodice, the sleeves terminating upwardly in sewn casings.

10. The adjustable dress of claim 9 and an elastic strip secured within each casing, each elastic strip being connected to a string extending outwardly of a respective casing.

11. The adjustable dress of claim 10 wherein the string extending from the sleeve casing contacts and is adjustably secured to the fabric string secured to the blouse rear top, the securing comprising a tied knot.

12. The adjustable dress of claim 11 and a pouf secured to the top of a sleeve in position to cover the said tied knot.

13. The adjustable dress of claim 1 wherein the overskirt comprises a wide casing provided in the tops of the gores not secured to the waistband.

14. The adjustable dress of claim 13 and an elastic strip positioned within the wide casing, the elastic strip having first and second ends.

15. The adjustable dress of claim 14 wherein the wide casing is provided with an opening and wherein the first end of the elastic strip projects through the opening.

16. The adjustable dress of claim 15 wherein the second end of the elastic strip is secured within the wide casing.

17. The adjustable dress of claim 16 wherein the second end of the elastic strip is secured immediately adjacent to the said open placket.

18. The adjustable dress of claim 17 wherein seams are provided to secure adjacent overskirt gores together and wherein portions of the said seams are drawn up to form gathers, the gathers providing a shirred effect to the adjustable dress.

* * * * *